US007190340B2

(12) United States Patent
Sugino

(10) Patent No.: US 7,190,340 B2
(45) Date of Patent: Mar. 13, 2007

(54) LIQUID CRYSTAL DISPLAY

(75) Inventor: Michiyuki Sugino, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 433 days.

(21) Appl. No.: 10/622,570

(22) Filed: Jul. 21, 2003

(65) Prior Publication Data

US 2004/0041767 A1 Mar. 4, 2004

(30) Foreign Application Priority Data

Aug. 2, 2002 (JP) ..... 2002-226385

(51) Int. Cl.
*G09G 3/36* (2006.01)

(52) U.S. Cl. ..... 345/98; 345/89; 345/690

(58) Field of Classification Search ..... 345/87, 345/89, 98, 690, 100, 204, 601
See application file for complete search history.

(56) References Cited

U.S. PATENT DOCUMENTS 6,727,877 B2 * 4/2004 Itakura ..... 345/94
2001/0024181 A1 * 9/2001 Kubota et al. ..... 345/87
2002/0047821 A1 4/2002 Miyake
2002/0050965 A1 5/2002 Oda et al.
2003/0006951 A1 * 1/2003 Ito ..... 345/89
2003/0179170 A1 * 9/2003 Lee ..... 345/87

FOREIGN PATENT DOCUMENTS

JP 9-81083 A 3/1997
JP 2002-062850 A 2/2002

* cited by examiner

*Primary Examiner*—Amr A. Awad
*Assistant Examiner*—Seokyun Moon
(74) *Attorney, Agent, or Firm*—Birch, Stewart, Kolasch & Birch, LLP

(57) ABSTRACT

A liquid crystal display is constructed so that the representative gray scale levels are extracted and set at close intervals in the gray scale transition areas where the optical response characteristics of the LCD panel are poor while the representative gray scale levels are set at dispersed intervals in the gray scale transition area where the optical response characteristics of the LCD panel is relatively good, to thereby allot the selected representative gray scale levels to the addresses of the OS table. A write gray scale determining portion, referring to compensation signal data values stored in correspondence with the combinations of the respective representative gray scale levels, determines the write gray scale data to the LCD panel, whereby the optical response characteristics of the LCD panel can be compensated with high precision.

4 Claims, 5 Drawing Sheets

| | | Address (current image data : 8bit) | | | | | | | | | | | | | | | |
|---|---|---|---|---|---|---|---|---|---|---|---|---|---|---|---|---|---|
| | | 0 | 1 | 2 | 3 | 4 | 5 | | | | | 250 | 251 | 252 | 253 | 254 | 255 |
| Address (previous image data : 8bit) | 0 | 0 | 2 | 4 | 6 | 8 | 9 | | | | | 252 | 253 | 254 | 255 | 255 | 255 |
| | 1 | 0 | 1 | 2 | 5 | 7 | | | | | | | 253 | 264 | 255 | 255 | 255 |
| | 2 | 0 | 0 | 2 | 4 | 6 | | | | | | | 253 | 254 | 255 | 255 | 255 |
| | 3 | 0 | 1 | 1 | 3 | 4 | | | | | | | 253 | 254 | 255 | 255 | 255 |
| | 4 | 0 | 2 | 3 | 3 | | | | | | | | | 254 | 255 | 255 | 255 |
| | 5 | 0 | | | | | | | | | | | | | | | 255 |
| | | | | | | | | | | | | | | | | | |
| | | | | | | | | | | | | | | | | | |
| | | | | | | | | | | | | | | | | | |
| | 250 | 0 | | | | | | | | | | | | | | | 255 |
| | 251 | 0 | 0 | 0 | 1 | | | | | | | | 251 | 253 | 255 | 255 | 255 |
| | 252 | 0 | 0 | 0 | 1 | 2 | | | | | | | 250 | 252 | 255 | 255 | 255 |
| | 253 | 0 | 0 | 0 | 1 | 2 | | | | | | | 250 | 251 | 253 | 255 | 255 |
| | 254 | 0 | 0 | 0 | 1 | 2 | | | | | | | 249 | 250 | 252 | 254 | 255 |
| | 255 | 0 | 0 | 0 | 1 | 2 | 3 | | | | | 247 | 249 | 250 | 252 | 254 | 255 |

FIG. 3 PRIOR ART

Previous frame data

Current frame data

| | 0 | 32 | 64 | 96 | 128 | 160 | 192 | 224 | 255 |
|---|---|---|---|---|---|---|---|---|---|
| 0 | | | | | | | | | |
| 32 | | | | | | | | | |
| 64 | | | | | | | | | |
| 96 | | | | | | | | | |
| 128 | | | | | | | | | |
| 160 | | | | | | | | | |
| 192 | | | | | | | | | |
| 224 | | | | | | | | | |
| 255 | | | | | | | | | |

LIQUID CRYSTAL DISPLAY

BACKGROUND OF THE INVENTION (1) Field of the Invention

The present invention relates to a liquid crystal display for displaying images through a liquid crystal display panel, in particular, relating to a liquid crystal display which is improved in the optical response characteristics upon occurrence of a gray scale transition in the liquid crystal display panel.

(2) Description of the Prior Art

Recently, personal computers, television receivers and the like use flat panel type displays such as liquid crystal displays (LCDs). A liquid crystal display includes a liquid crystal display panel made up of two glass substrates with electrodes, a liquid crystal substance injected between them and a driver circuit, and controls the amount of transmitted light by changing the strength of the electric field between the electrodes so as to display a desired image.

In order to increase the response speed, most liquid crystal display panels utilize TFT LCDs which employ a thin-film transistor (TFT) switching element for each pixel.

Recently, liquid crystal displays for computers, to say nothing of those used for television receivers, have become required to display motion pictures. Therefore, there are response speed deficiency problems even with TFT LCDs. To deal with this, a technique has been devised, in which high-level signals or low-level signals are temporarily applied when drive signals for the liquid crystal display panel are changed. This method, however, tends to produce overshoot when the voltage changes from low to high levels and undershoot when the voltage changes from high to low levels, resultantly being unpreferable in view of visibility.

As countermeasures against this problem, a technique is published in Japanese Patent Application Laid-open 2002-62850, in which signal correction is performed based on a compensation signal table registered in table memory so as to compensate the optical response characteristics of the LCD panel.

FIG. 1 is a block diagram showing a conventional liquid crystal display, and FIG. 2 is an illustrative view showing a signal table.

This liquid crystal display includes a LCD panel 10, a reference table memory 11, a frame memory 12, a control circuit 13, a data input terminal 14, a synchronizing signal input terminal 15, a data bus 16 for reference table memory 11 and an address bus 17 for reference table memory 11.

In this liquid crystal display, it is assumed that LCD panel 10 handles 8 bit display data, data with 256 levels of gray scales. The image data input from input terminal 14 is given to the 8 bits of the address of reference table memory 11 as well as to frame memory 12. The frame memory 12 outputs image data, one display period before, or delayed by one display period, and this delayed data is input to the remaining 8 bits of the address of reference table memory 11.

In reference table memory 11, compensation signal data (actual measurement) for enabling LCD panel 10 to achieve proper optical response within one display period when a signal level transition takes place is written in beforehand for all the gray scale transitions, or for all the combinations of variation of signal levels. For example, as shown in FIG. 2, the compensation signal data is represented in a 256×256 matrix form, so that a combination of the image data values of the current vertical display period and the previous vertical display period will determine a compensation signal data value to be written into LCD panel 10.

By preparing the reference table memory with the above compensation signal data written in, the desired display signal level, continuously determined based on the signal level to be displayed at present and the signal level at the time one display period ago, can be applied as the compensation signal data to LCD panel 10, whereby it is possible to achieve high-speed response display with compensated optical response characteristics of LCD panel 10 for any possible signal level change (gray scale transition).

When the compensation signal data values as to all the gray scale transitions of 256×256 patterns, from one to the next vertical display periods, are stored in the memory as in the reference table in FIG. 2, a large memory capacity is needed. Therefore, as shown in FIG. 3, nine representative gray scale levels may be extracted at uniform intervals of every 32 levels of gray scales, for example, from the 256 levels in each vertical display, of one vertical display and of the next, so as to create a table for storing compensation signal data for only the 9×9 gray scale transition patterns while the compensation signal data corresponding to the gray scale transition patterns for gray scale levels other than the above representative gray scale levels may be determined by linear interpolation using the compensation signal data in the above reference table.

In the above way, when compensation signal data (actual measurement) for the representative gray scale levels only is stored in the reference table memory, it is possible to reduce the amount of memory compared to the reference table memory for storing the compensation signal data (actual measurement) for all the transitions of 256×256 patterns. However, since the compensation signal data for the gray scale levels between the representative gray scale levels should be determined by linear interpolation, the precision of the compensation signal data cannot help but degrade.

To sum up, there exists a tradeoff relationship between the amount of memory for the reference table memory and the compensation accuracy of the optical response characteristics of the LCD panel, hence it has been difficult to improve the compensation accuracy of the optical response characteristics of the LCD panel while reducing the amount of memory for the reference table memory.

SUMMARY OF THE INVENTION

In view of the above circumstances, it is an object of the present invention to provide a liquid crystal display which enables high accuracy compensation of the optical response characteristics of a LCD panel with a reduced amount of reference table memory, by allotting representative gray scale levels distributed at arbitrary intervals on a compensation signal data table (an OS table) in accordance with the optical response characteristics of the LCD panel.

In accordance with the present invention, a liquid crystal display including a table memory for storing compensation signal data for compensating the input signals for the optical response characteristics of an LCD panel, in accordance with gray scale transitions from the previous to current vertical display periods, and a gray scale determining means for determining a write gray scale signal to the LCD panel based on the compensation signal data, is characterized in that the table stored in the table memory stores each compensation signal data value corresponding to the combination of a representative gray scale level of the image signal in the current vertical display period and that of the image signal in the previous vertical display period, and the representative gray scale levels for each are set at varying intervals, close and dispersed intervals, depending on the optical response characteristics of the LCD panel.

Here, the table is constructed so that the representative gray scale levels are set at close intervals in the gray scale transition areas where the optical response speed of the LCD panel is more heterogeneous and the representative gray scale levels are set at dispersed intervals in the gray scale transition areas where the optical response speed of the LCD panel is less heterogeneous.

Further, the gray scale determining means is characterized by determining compensation signal data values corresponding to the combinations of gray scale levels between representative gray scale levels, by calculation based on the compensation signal data stored in the table in correspondence with the combinations of representative gray scale levels.

BRIEF DESCRIPTION OF THE DRAWINGS

FIG. 3 is an schematic illustrative view showing another table example for a conventional liquid crystal display;

DESCRIPTION OF THE PREFERRED EMBODIMENTS

The embodiment of the present invention will hereinafter be described in detail with reference to FIG. 4 through FIGS. 7A and 7B.

As has been described in the prior art, in order to enhance the optical response speed of the liquid crystal, there is a known liquid crystal display driving method in which a higher (overshot) drive voltage, or lower (undershot) drive voltage, than the designated gray scale voltage corresponding to the input image signal for the current frame is supplied to the LCD panel, in accordance with the combination of the input image signal of the previous frame and that of the current frame. In the present invention, this driving scheme will be given the term the overshoot (OS) drive, hereinbelow.

Figures 1, 2:
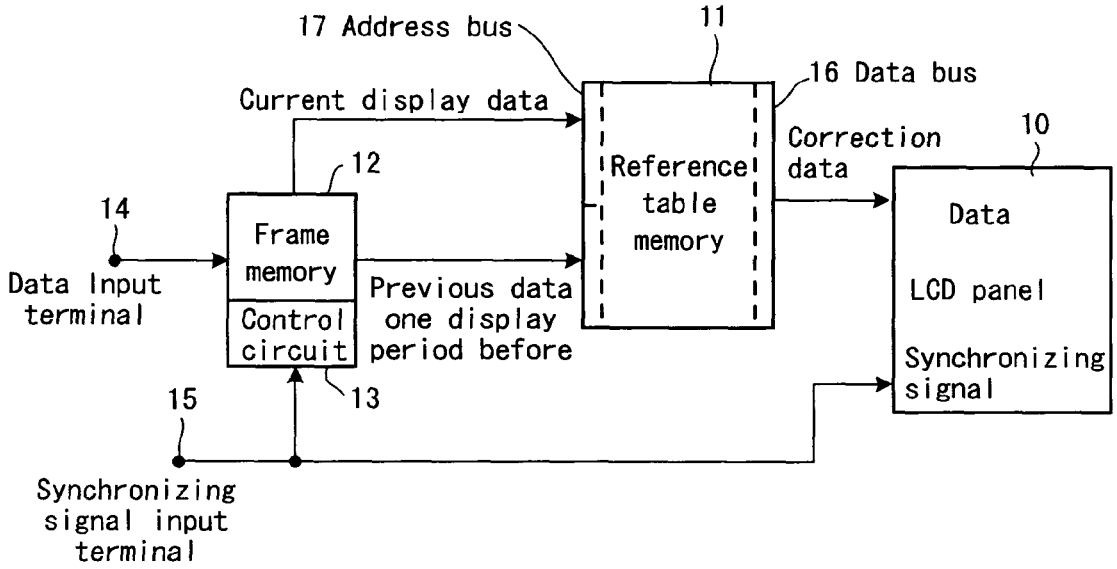
FIG. 1 PRIOR ART
FIG. 2 PRIOR ART
FIG. 1 is a block diagram showing a schematic configuration of essential parts of a conventional liquid crystal display.
FIG. 2 is a schematic illustrative view showing a table example for a conventional liquid crystal display.
Figure 4:
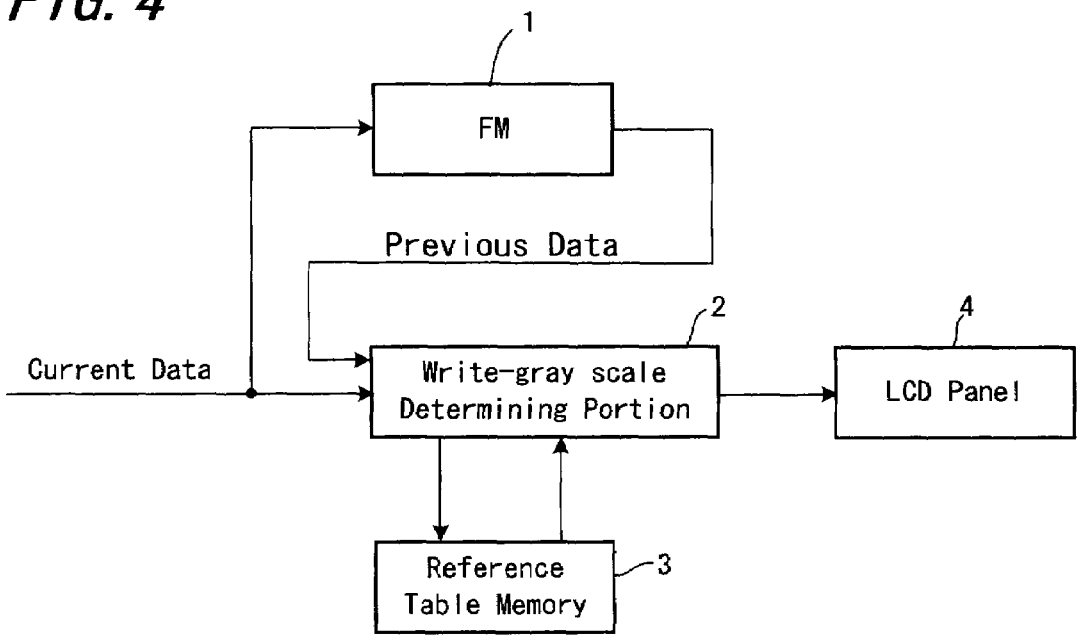
FIG. 4 is a block diagram showing a schematic configuration of essential parts of a liquid crystal display of the present embodiment.

In a liquid crystal display shown in FIG. 4 the input image data (current data) of the N-th frame to be next displayed and the input image data (previous data) of the (N−1) th frame stored in a frame memory 1 are read into a write gray scale determining portion 2, where the gray scale transition pattern between them and the input image data in the N-th frame are checked in comparison with the OS table (compensation signal data table) stored in reference table memory 3. The compensation signal data obtained from the comparison is applied to an LCD panel 4, as the write gray scale data for N-th frame image display.

Figure 5:
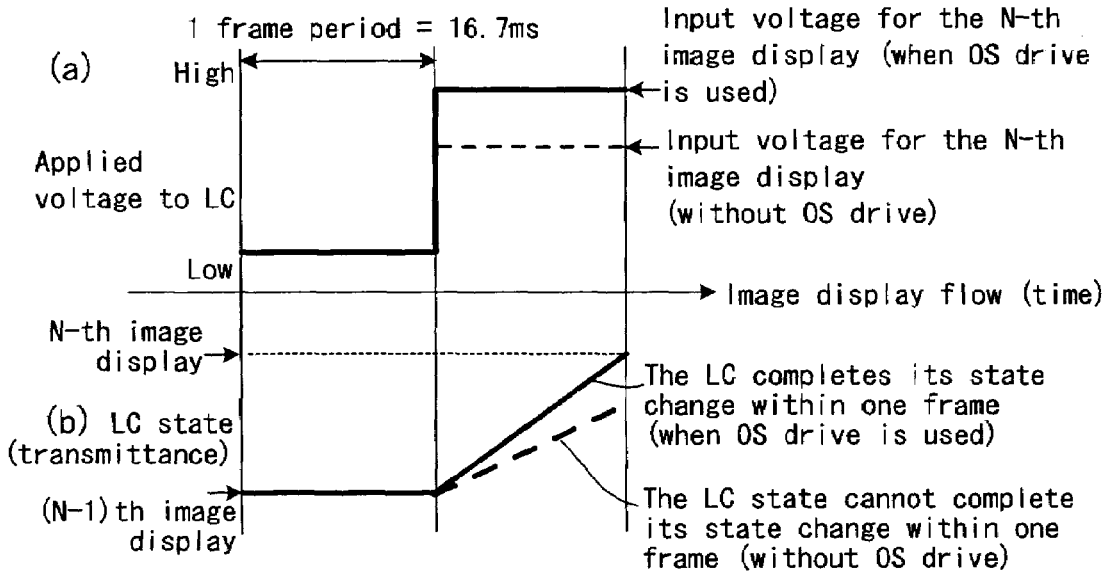
FIG. 5 is an illustrative chart showing the relationship between the applied voltage to the liquid crystal and the liquid crystal response.

With general LCD panels, there has been a problem that it takes too long a time to change the display from a certain medium gray scale to another, hence the medium gray scales cannot be displayed within the one frame period (e.g., 16.7 msec for progressive scan display at 60 Hz) without producing an afterimage and cannot be reproduced correctly, either. Use of the above-described overshoot drive makes it possible to display the aimed medium gray scale within the one frame period, as illustrated in FIG. 5.

Figure 6:
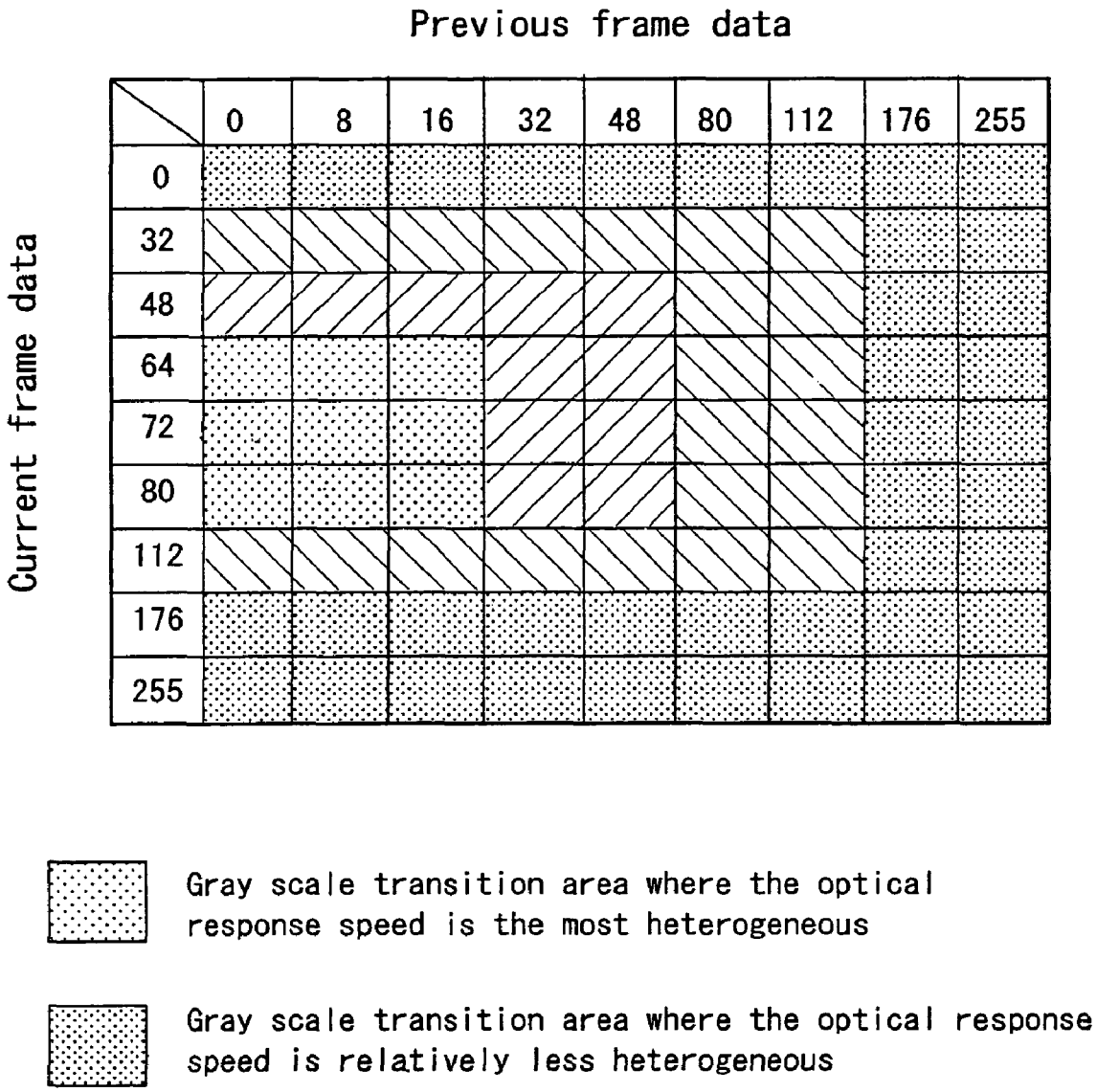
FIG. 6 is a schematic illustrative view showing a table example for a liquid crystal display of the present embodiment.

Here, in the OS table of this embodiment, as shown in FIG. 6, nine representative gray scale levels are picked up from the 256 levels for representing image signals, and a compensation signal data value for compensating the optical response characteristics of LCD panel 4 is allotted for each combination of representative gray scale levels in the previous frame and the current frame. The compensation signal data values stored herein are obtained from the actual measurement of the optical response characteristics of LCD panel 4 used in the device. That is, the values obtained from the actual measurement for compensation of the optical response characteristics of LCD panel 4 are stored in the OS table in correspondence with the each gray scale transition pattern between the representative gray scales.

Here, the representative gray scale levels allotted for each address of the OS table need not to be picked up at regular intervals but may be set at arbitrary or irregular intervals, as shown in FIG. 6, for example.

Figure 7A:
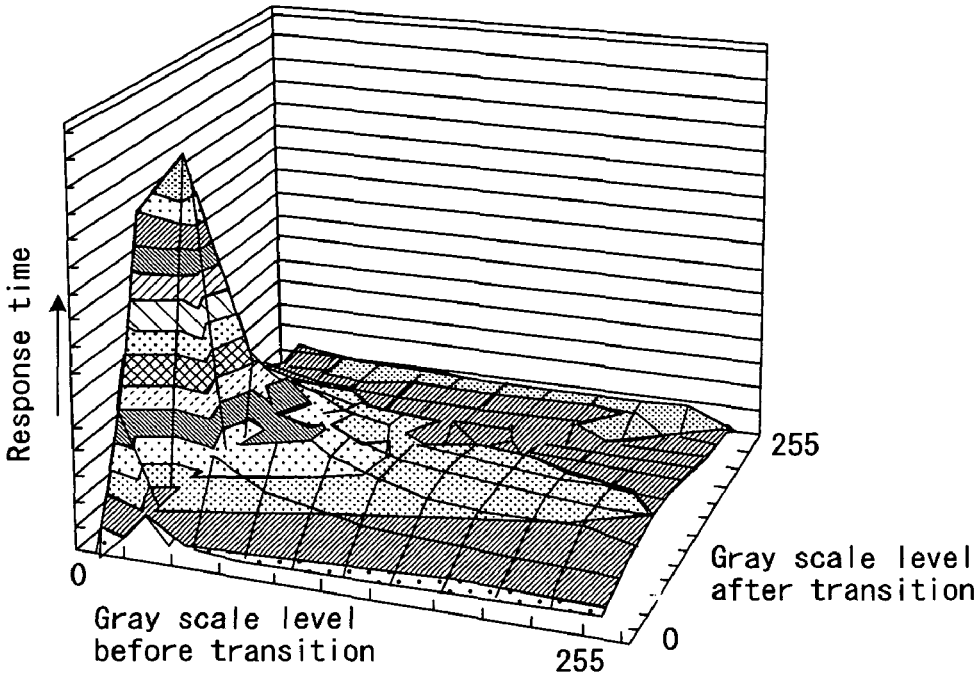
FIGS. 7A and 7B are illustrative views showing the optical response characteristics of a liquid crystal display panel.
Figure 7B:
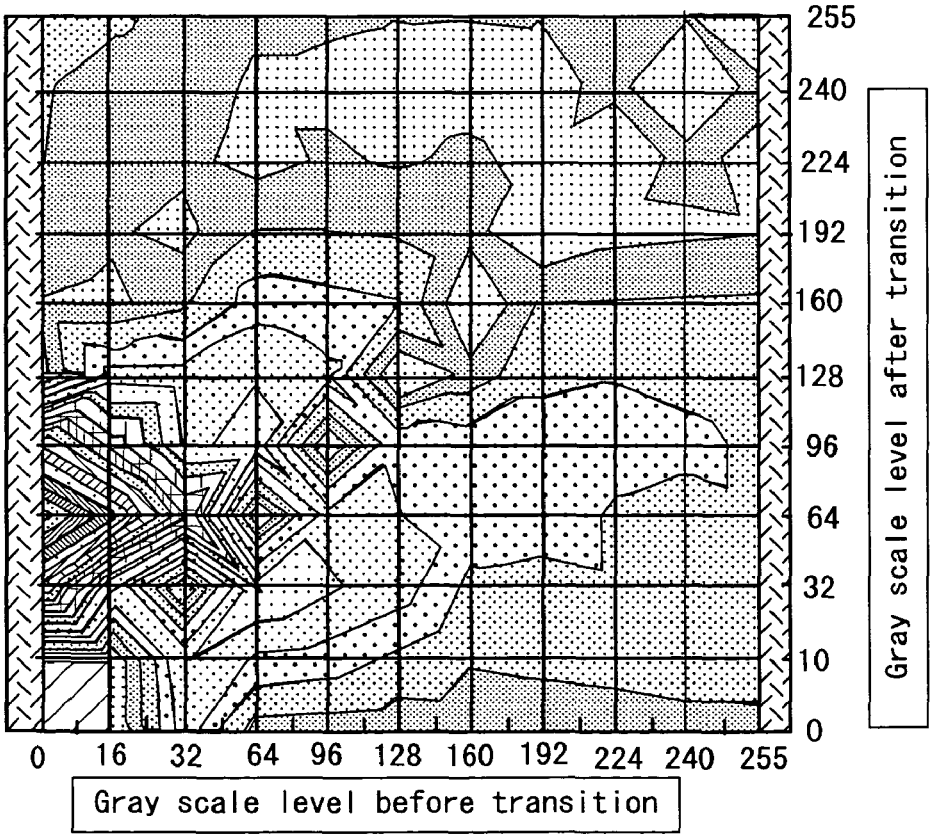

This is based on the fact that the optical response characteristics of LCD panel 4, i.e., the time characteristics (optical response speed) required to reach the aimed gray scale (the intensity of light transmission) in correspondence to each combination of gray scale levels in the previous frame and in the current frame is not uniform, as shown in FIG. 7A. In FIG. 7B, the direction perpendicular to the document surface indicates the time required for the input gray scale data at the current frame to be displayed with respect to the gray scale transition from the previous frame to the current frame. It should be noted that the optical response characteristics of LCD panel 4 are determined depending on the orientation mode of the liquid crystal, the liquid crystal material, the orientation restraining force of the electrode pattern for applying electric fields to the liquid crystal material and other factors. That is, the optical response characteristics shown in FIGS. 7A and 7B only show a general example of a specific LCD panel.

As apparent from FIGS. 7A and 7B, the response speeds of the liquid crystal in accordance with gray scale transitions are significantly diverse depending on the gray scale transition patterns. When taking an overview of the response speeds across the whole gray scale transition patterns, it is understood that the response time becomes markedly long (the optical response speed becomes low) in part of, or for some, gray scale transitions. There are some areas of gray scale transitions where the response time upon the gray scale transition becomes markedly long, that is, the optical response speed is more heterogeneous, and other areas of gray scale transitions where the response time upon the gray scale transition is almost uniform, that is, the optical response speed is less heterogeneous.

Accordingly, in the present embodiment, representative gray scale levels allotted to the OS table are set at arbitrary intervals depending on the optical response characteristics of LCD panel 4. Specifically, the representative gray scale levels are extracted, set up and allotted to each address of the OS table, in such a manner that the representative gray scale levels are set at close intervals in the gray scale transition areas where the optical response speed of LCD panel 4 is more heterogeneous while the representative gray scale levels are set at dispersed intervals in the gray scale transition area where the optical response speed of LCD panel 4 is relatively less heterogeneous.

Write gray scale determining portion 2 determines the compensation signal data values corresponding to the combinations of gray scale levels between representative gray scale levels (gray scale transitions), which are not in the table, by implementing linear interpolation based on the compensation signal data (actual measurement) stored in the OS table. This makes it possible to determine the compensation signal data corresponding to all the gray scale level combinations (256×256), which can be output as the write gray scale signals to LCD panel 4.

As has been described, since the OS table of this embodiment is created so that the representative gray scale levels are set at close intervals in the gray scale transition areas where the optical response speed of LCD panel 4 is more heterogeneous, the compensation signal data obtained by linear interpolation can be determined with high precision, whereby the optical response characteristics of LCD panel 4 can be improved in a correct manner. On the other hand, the representative gray scale levels are set at dispersed intervals in the gray scale transition area where the optical response speed of LCD panel 4 is less heterogeneous but the optical response speeds between the representative gray scale levels within the range are mostly uniform, so that it is possible to obtain compensation signal data with high enough precision by linear interpolation. Accordingly, the quantity of memory required for reference table memory 3 can be reduced to a great degree.

The above embodiment was described with reference to the OS table given in the form of 9×9 matrix, but the present invention should not be limited thereto. For example, the OS table may be given in an arbitrary matrix form such as 5×5 matrix, 16×16 matrix, or the like. It is also obvious that, for an OS table created using the finite element method based on a mesh of triangles, the representative gray scale levels picked up, some closely and others more dispersed (at arbitrary intervals) based on the optical response characteristics of the LCD panel can be allotted to the vertexes of the meshed triangles.

Moreover, in the above description of the embodiment, the compensation signal data values corresponding to the gray scale levels between representative gray scale levels are determined by linear interpolation using the compensation signal data values corresponding to the representative gray scale levels, but the present invention should not be limited to this calculation method.

Since the liquid crystal display of the present invention is constructed so that representative gray scale levels allotted to the table are selected, some at close intervals and other at dispersed intervals, depending on the optical response characteristics of the LCD panel, it is possible to compensate the optical response characteristics of the LCD panel with high precision while reducing the size of the table memory.

What is claimed is:

1. A liquid crystal display including a table memory for storing compensation signal data for compensating the input signals for the optical response characteristics of an LCD panel, in accordance with gray scale transitions from the previous to current vertical display periods, and a gray scale determining means for determining a write gray scale signal to the LCD panel based on the compensation signal data, characterized in that the table stored in the table memory stores each compensation signal data value corresponding to the combination of a representative gray scale level of the image signal in the current vertical display period and that of the image signal in the previous vertical display period, and the representative gray scale levels for each are set at varying intervals, close and dispersed intervals, depending on the optical response characteristics of the LCD panel.

2. The liquid crystal display according to claim 1, wherein the table is constructed so that the representative gray scale levels are set at close intervals in the gray scale transition areas where the optical response speed of the LCD panel is more heterogeneous, and the representative gray scale levels are set at dispersed intervals in the gray scale transition areas where the optical response speed of the LCD panel is less heterogeneous.

3. The liquid crystal display according to claim 1, wherein the gray scale determining means determines compensation signal data values corresponding to the combinations of gray scale levels between representative gray scale levels, by calculation based on the compensation signal data stored in the table in correspondence with the combinations of representative gray scale levels.

4. The liquid crystal display according to claim 2, wherein the gray scale determining means determines compensation signal data values corresponding to the combinations of gray scale levels between representative gray scale levels, by calculation based on the compensation signal data stored in the table in correspondence with the combinations of representative gray scale levels.

* * * * *